US006053358A

United States Patent [19]

Tong

[11] Patent Number: 6,053,358

[45] Date of Patent: Apr. 25, 2000

[54] LOTTERY MACHINE PREVENTING LOTTERIES FROM PULLING OUT ILLEGALLY

[76] Inventor: Hui-Jin Tong, P.O. Box 90, Tainan City, Taiwan

[21] Appl. No.: 09/133,212

[22] Filed: Aug. 13, 1998

[51] Int. Cl.[7] ..... B65H 3/00; G07F 11/16

[52] U.S. Cl. ..... 221/151; 221/152; 221/153; 221/255; 221/258; 221/277

[58] Field of Search ..... 221/151, 152, 221/153, 21, 258, 277, 255

[56] References Cited

U.S. PATENT DOCUMENTS

| | | | |
|---|---|---|---|
| 2,508,159 | 5/1950 | Haas | 221/153 |
| 4,728,090 | 3/1988 | Oota et al. | 221/258 |
| 4,993,587 | 2/1991 | Abe | 221/21 |
| 5,238,143 | 8/1993 | Crighton | 221/21 |
| 5,803,308 | 9/1998 | Rong | 221/255 |
| 5,938,073 | 8/1999 | Chang | 221/277 |

*Primary Examiner*—H. Grant Skaggs

[57] ABSTRACT

A lottery machine preventing lotteries from drawing out illegally mainly includes a base, a lottery moving device, a face plate and a coil spring. A micro switch is provided on one of two parallel side plates of the base, and held in ON condition by a stop pushed by the lottery moving device laid between two rails on the left side plate to move back and forth. A lottery is normally moved out of an outlet of the face plate by turning on a motor of the lottery moving device. But when a lottery is to be pulled out unlawfully, the lottery moving device can be moved forward by an external force pulling the lottery, cutting off the micro switch to stop the lottery moving device. Then the lottery may be pressed down firmly by an activating plate against a guider under the outlet, unable to be pulled out unlawfully.

1 Claim, 5 Drawing Sheets

LOTTERY MACHINE PREVENTING LOTTERIES FROM PULLING OUT ILLEGALLY

BACKGROUND OF THE INVENTION

This invention relates to a lottery machine preventing lotteries from pulling out illegally, particularly to one capable to pinch and hold tightly a lottery from unlawfully pulling out by means of a lottery moving device, which has an activating plate pressed by a face plate to sandwich a lottery firmly with a guider under the lottery and thus prevent it from drawing out of an outlet unlawfully.

At present common conventional lottery machines have an anti-steal device as shown in FIG. 1, includes a principal roller 10, a ratchet 11 fixed beside the principal roller 10, a control plate 12 fixed at one side of the ratchet 11 and having one end pivotally connected to a shaft 13 and the other end pivotally connected with a pin 14 to a frame 16 of a motor 15. A hook 17 is formed at an upper end of the control plate 12 engaging a tooth of the ratchet 11. When a lottery A is pulled out by an external force, the pulling force of the lottery is transmitted to the principal roller 10, the shaft 18, gears 19, 190, permitting the frame 16 move up the connect point of the motor 15 and the control plate 12, with the control plate 12 moving up with the shaft 13 as a pivot so that the hook 17 may engage a tooth of the ratchet 11, stopping the lottery, which then cannot be pulled out illegally.

The structure of the anti-steal device of the conventional lottery machine is too complicated, resulting in high cost, difficult assemblage, and high disorder percentage.

SUMMARY OF THE INVENTION

This invention has been devised to offer a lottery machine preventing lotteries from drawing out illegally.

The main feature of the invention is a lottery moving device located in a base consisting of two parallel plates, and fitted in two rails provided on an inner surface of one of the two side plates for the lottery moving device to move back and forth. When a lottery pinched between a principal roller and a subordinate roller is pulled out of an outlet by an external force unlawfully, the lottery moving device is possible to be moved forward to be stopped by a face plate, and at the same time an activating plate of the lottery moving device may be forced down by a sloped surface formed on the outlet to sandwich the lottery with a guider under the outlet, hampering-the lottery from pulled out of the outlet unlawfully.

BRIEF DESCRIPTION OF DRAWINGS

This invention will be better understood by referring to the accompanying drawings, wherein.

DETAILED DESCRIPTION OF THE PREFERRED EMBODIMENT

Figure 1A:
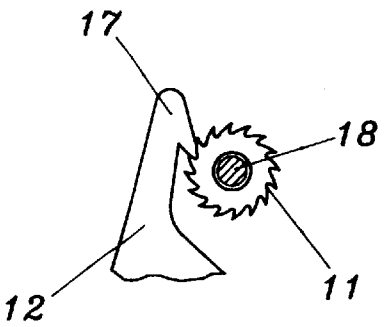
FIG.1A (PRIOR ART)
FIG. 1 is a side structural view of a known conventional lottery machine.
Figure 1:
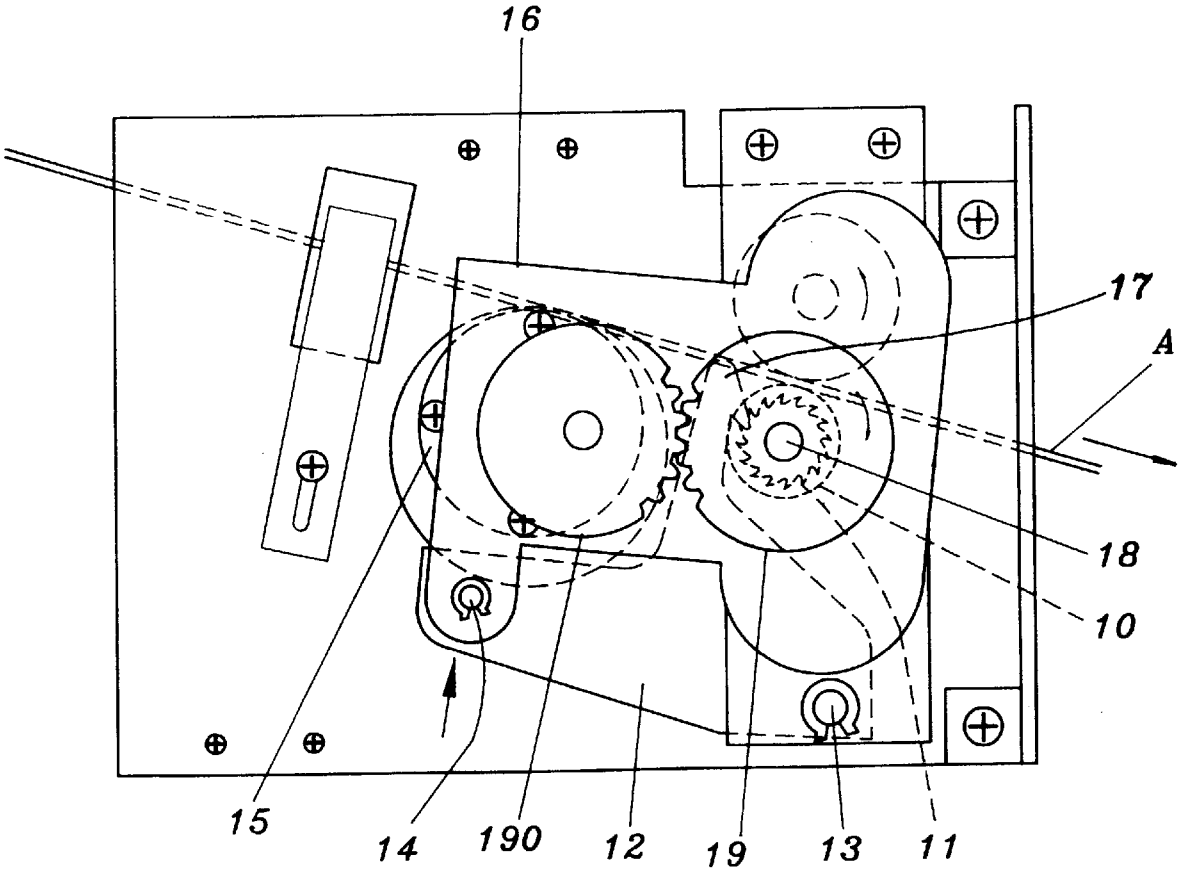
FIG.1 (PRIOR ART)
Figure 2:
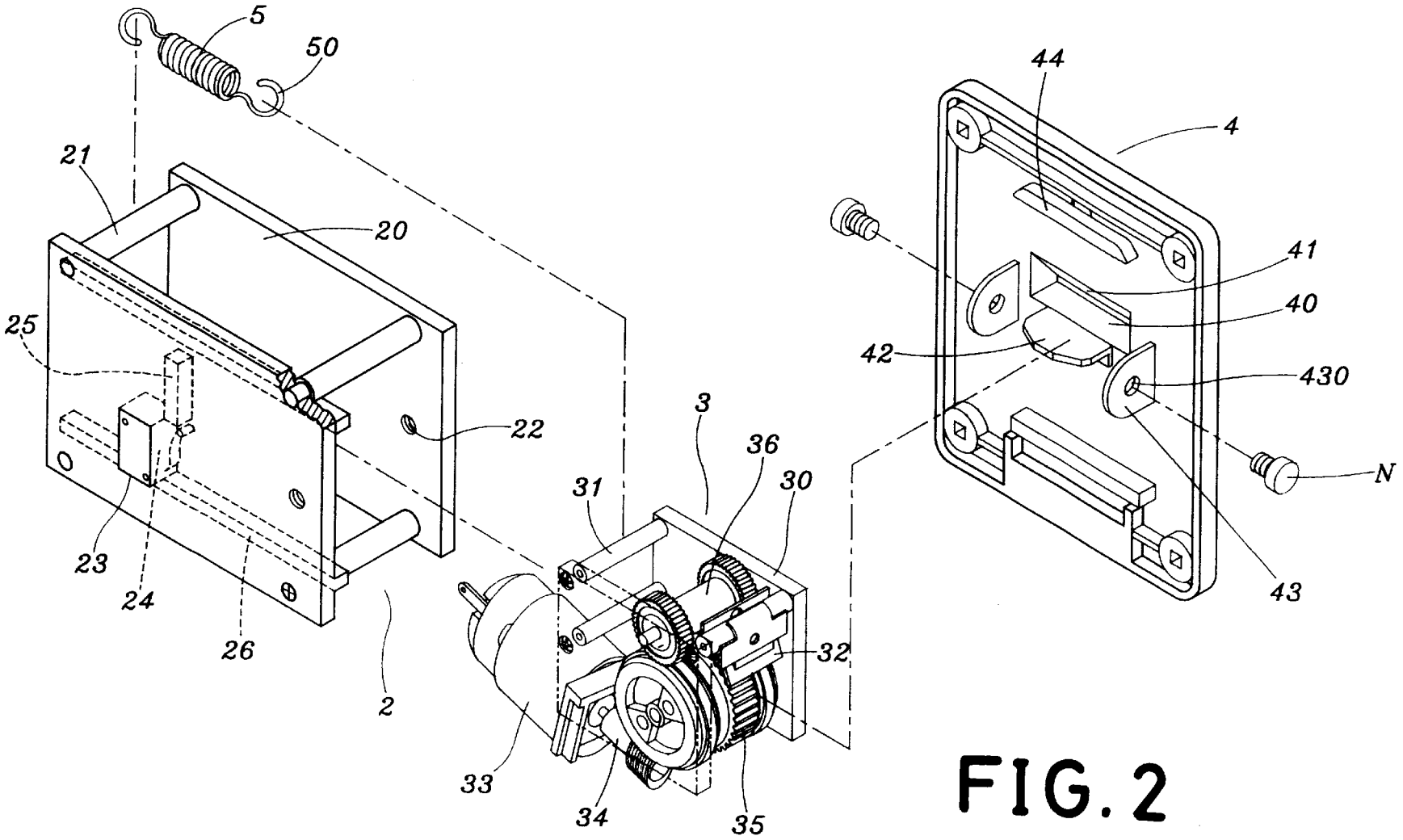
FIG. 2 is an exploded perspective view of a lottery machine preventing lotteries from drawing out illegally in the present invention.

A preferred embodiment of a lottery machine preventing lotteries from pulling out illegally, as shown in FIG. 2, includes a base 2, a lottery moving device 3, a face plate 4 and a spring 5 as main components.

The base 2 has two side parallel plates 20, a plurality of connect rods 21 connecting the two side plates 20 together. The two side plates 20 respectively have an aligned threaded hole 22 in a front portion, a left side plate 20 has a rectangular hole 23 for placing a micro switch 24 therein, a stop 25 fixed on an inner surface on the micro switch 24, and rails 26 respectively on the inner surface under the micro switch and above the stop 25.

The lottery moving device 3 is placed between the rails 26 on the left side plate 20 of the base 2, consisting of a position base 30, a plurality of connect rods 31, an activating plate 32, a motor 33, a worm 34, a principal roller 35, and a subordinate roller 36. The connect rods 31 are laterally fixed spaced apart on the position base 30, and the front upper connect rod 31 combined with the activating plate 32. The motor 33 is located at a rear portion and has its shaft connected to the worm 34 engaging the principal roller 35 located on the worm 34.

The face plate 4 is combined with the front sides of the two side plates 20 of the base 2, having a lottery outlet 40 in the center portion, a sloped surface 41 extending down and forward to the lottery outlet 40, a guider 42 fixed inside just under the outlet 40, two pivotal ears 43 fixed inside at two sides of the outlet 40 and a position block 44 fixed inside above the outlet 40. The pivotal ears 43 respectively have a center threaded hole 430 facing the threaded hole 22 of the base 2 for screws to combine the face plate 4 with the base 2.

The coil spring 4 has two hook ends 50 to hook with the connect rod 21 of the base 2 and that 31 of the lottery moving device 3.

Figure 3:
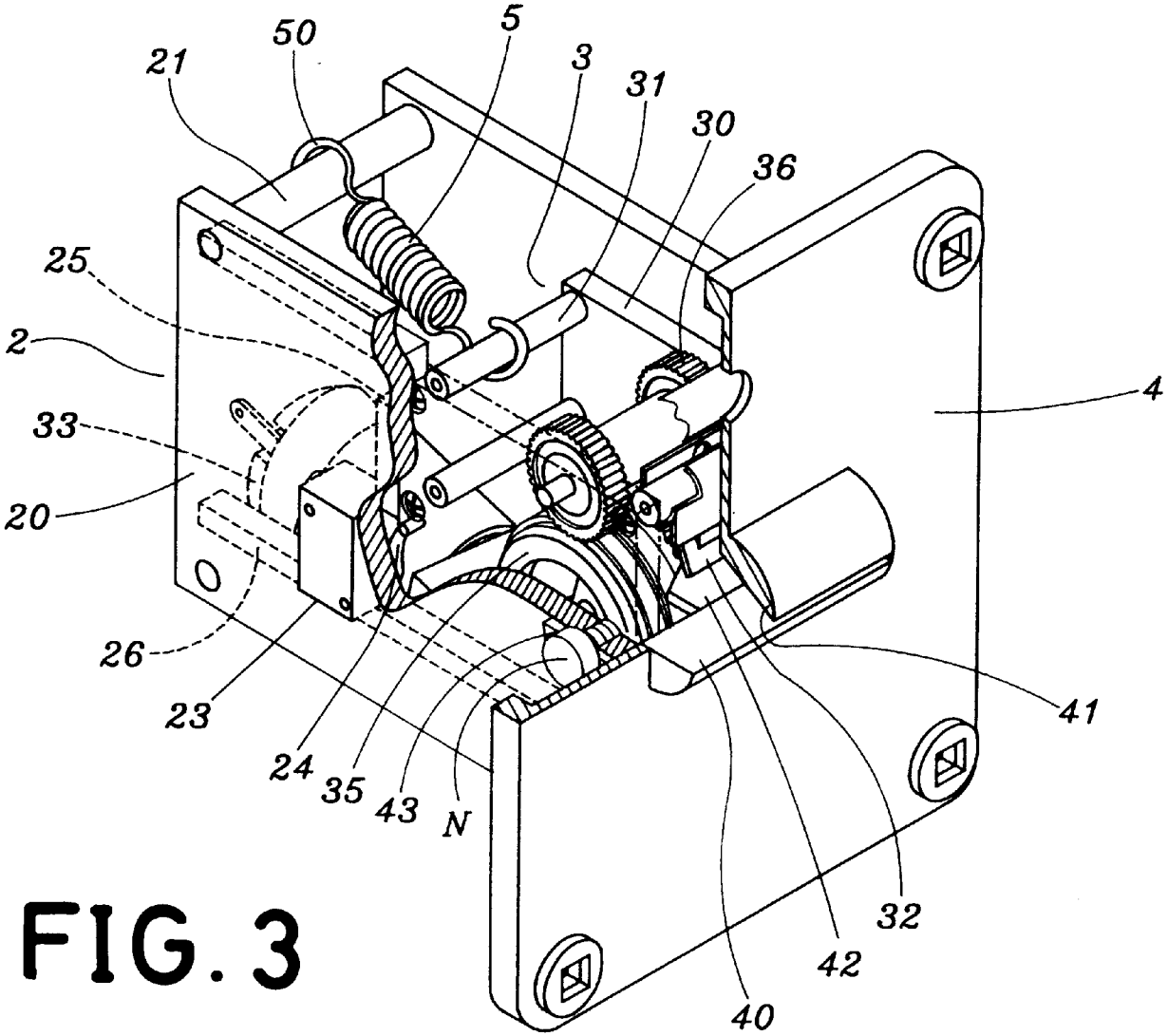
FIG. 3 is a perspective view of the lottery machine preventing lotteries from drawing out illegally in the present invention.

In assembling, referring to FIG. 3, firstly the lottery moving device 3 is assembled with the front side of the base 2, with the position base 30 placed on the rail 26. Then the face plate 4 is assembled in the front portion of the base 2, with the pivotal ears 43 and the position block 44 fitting firmly in the front portion of the base 2, and with the threaded holes 22 facing the center threaded holes 430 of the ears 43 and then screws N used to fix them together. Lastly, the coil spring 5 is fixed between the connect rods 21 and 31 of the base 2 and the lottery moving device 3, with the stop 25 contacting the rear side of the position base 30 and also contacting the micro switch 24 to make the micro switch 24 ON. Then the lottery machine is finished in assemblage.

Figure 4:
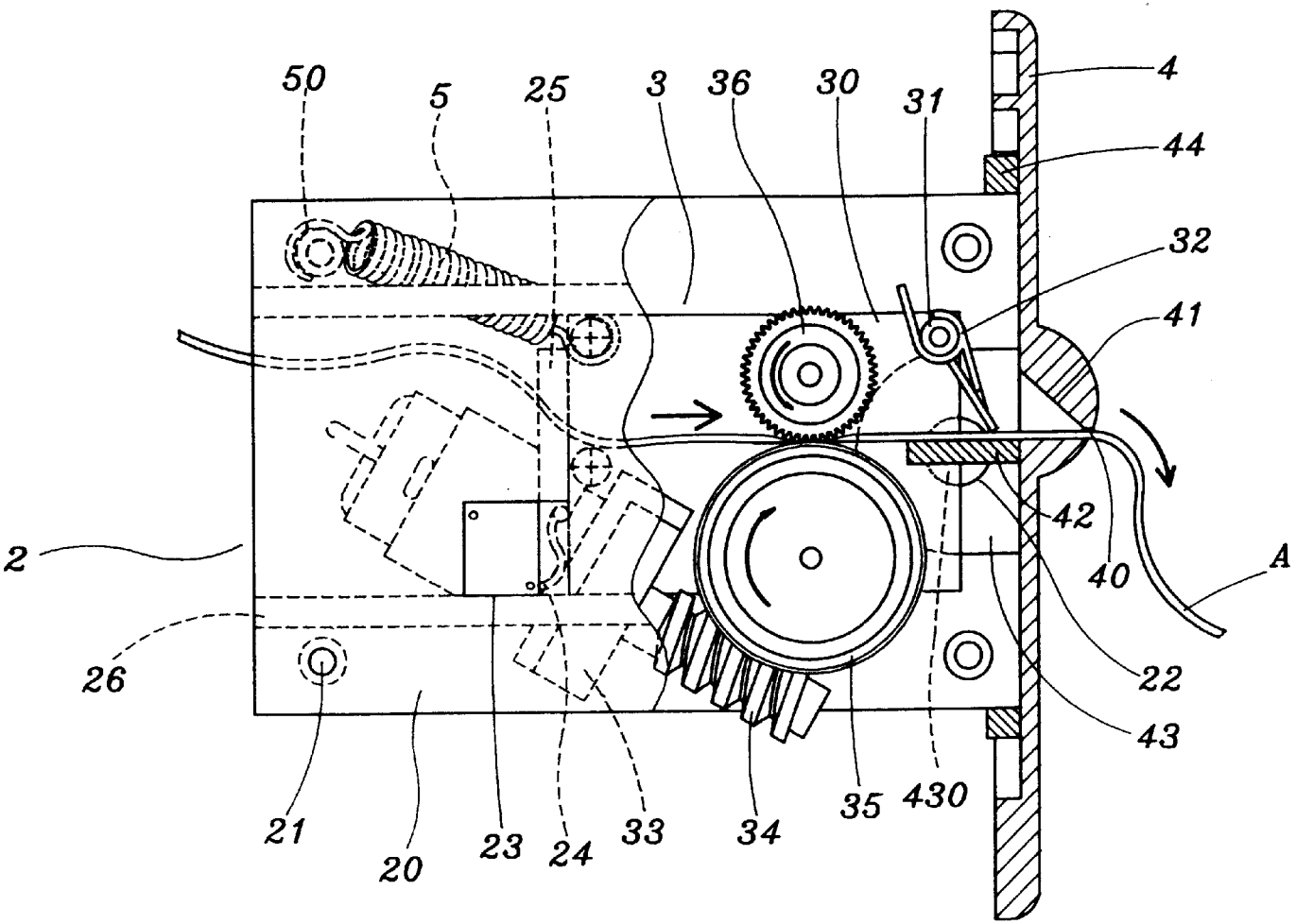
FIG. 4 is a side view of the lottery machine in the present invention, showing how a lottery is moved out; and, FIG. 5 is a side view of the lottery machine in the present invention, showing how a lottery is held, not to be drawn out illegally.
Figure 5:
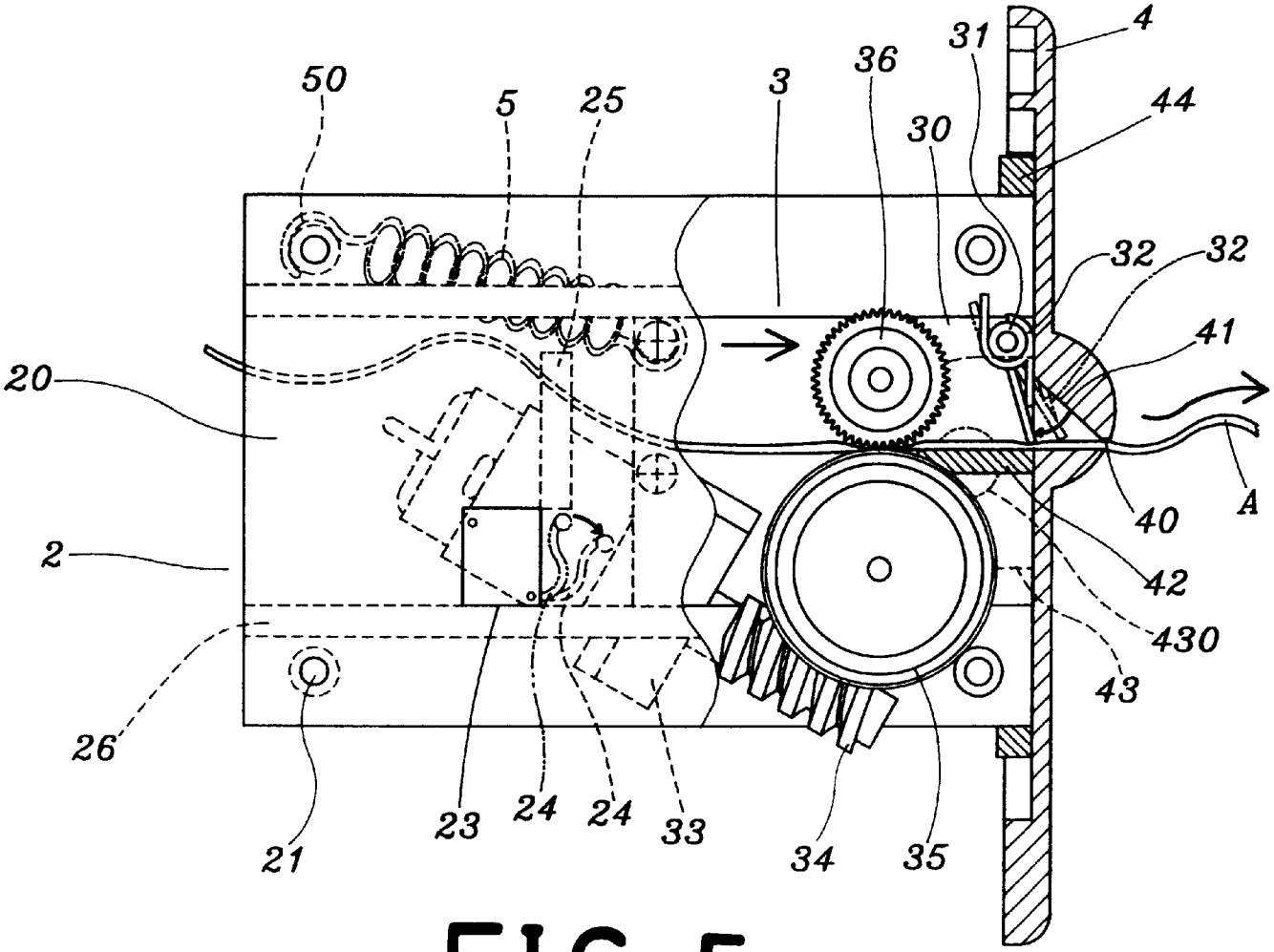

In using, referring to FIGS. 4 and 5, if the motor 33 of the lottery move device 3 is turned on, the worm 34 is rotated to rotate the principal roller 35, which then rotates the subordinate roller 36 in reverse direction, letting a lottery A pinched between the principal and the subordinate roller 35 and 36 move forward out of the outlet 40. Should-a lottery A be tried to be pulled out unlawfully by an external force, the lottery moving device 3 would be moved forward by the pulling force and stopped by an inner side of the face plate 4, cutting off the micro switch 24 so far being in ON condition. At the same time, the activating plate 32 may be forced down by the sloped surface 41 of the face plate 4 to press against the guider 42 and firmly sandwich the lottery A between, surely hampering the lottery from drawing out unlawfully.

As the lottery moving device 3 is hooked by the coil spring 5, the coil spring 5 may produce elasticity when the lottery moving device 3 is moved forward to pull somewhat the coil spring 5. But when the external force drawing the lottery A disappears, the lottery moving device 3 is then withdrawn back along the rails 26 of the base 2 to its normal position by the coil spring 5 recovering its resiliency. Therefore, the stop 25 may contact again the micro switch 24 to turn the micro switch 24 ON, permitting the motor 33 to operate again.

As can be understood from the aforesaid description, the lottery machine in the present invention has the following advantages:

1. Lotteries may surely be prevented from drawing out unlawfully.
2. It has a simple structure to be easily assembled or taken apart.

While the preferred embodiment of the invention has been described above, it will be recognized and understood that various modifications may be made therein and the appended claims are intended to cover all such modifications which may fall within the spirit and scope of the invention.

What is claimed is:

1. A lottery machine preventing lotteries from drawing out unlawfully comprising:

a base having two side parallel plates, said two side plates respectively provided with a threaded hole in a front portion, a left one of said side plates provided with a rectangular hole for placing a micro switch therein, a stop fixed on an inner surface of said left side plate just on said micro switch, and two rails fixed respectively on said inner surface of said left side plate one under said micro switch and one above said stop, a plurality of connect rods connecting firmly said two side plates spaced apart with a hollow space;

a lottery moving device located in said hollow space defined by said two side plates of said base and placed between said two rails, able to move along said rails forward and backward, having an activating small plate;

a face plate-fixed at a front side of said base, having a lottery outlet, a sloped surface formed in an inner side thereof on said lottery outlet, a lottery guider fixed on said inner side thereof just under said outlet for guiding a lottery to move out of said outlet, two pivotal ears fixed on said inner side thereof at two sides of said outlet and having a threaded center hole, and a position block fixed on said inner side thereof;

a coil spring located between said base and said lottery moving device;

wherein when a lottery is moved forward said lottery moving device moves along said rails to let said lottery moving device contact and be stopped by said inner surface of said face plate and when the lottery is pulled unlawfully by a stealer, said micro switch, being in an ON condition, is at once changed to an OFF condition by movement of said lottery moving device to stop said motor of said lottery moving device and said activating plate is moved downward by said sloped surface of said outlet of said face plate to press firmly against said guider so that the lottery may be firmly sandwiched between said guider and said activating plate, and thus said lottery is unable to be pulled out of said outlet unlawfully.

* * * * *